US008399753B2

(12) United States Patent
Coleman

(10) Patent No.: US 8,399,753 B2
(45) Date of Patent: Mar. 19, 2013

(54) SLIDE FOR USE WITH FRETTED INSTRUMENTS

(76) Inventor: Colin D. Coleman, Hermosa Beach, CA (US)

( * ) Notice: Subject to any disclaimer, the term of this patent is extended or adjusted under 35 U.S.C. 154(b) by 0 days.

(21) Appl. No.: 12/931,197

(22) Filed: Jan. 26, 2011

(65) Prior Publication Data

US 2011/0192267 A1 Aug. 11, 2011

Related U.S. Application Data

(63) Continuation-in-part of application No. 12/387,038, filed on Apr. 28, 2009, now abandoned.

(51) Int. Cl.
*G10D 3/00* (2006.01)

(52) U.S. Cl. ..... 84/315

(58) Field of Classification Search ..... 84/315–317, 84/320–322

See application file for complete search history.

(56) References Cited

U.S. PATENT DOCUMENTS 1,741,285 A * 12/1929 Carpenter ..... 84/322
2007/0175311 A1* 8/2007 Sloan ..... 84/315

* cited by examiner

*Primary Examiner* — Kimberly Lockett
(74) *Attorney, Agent, or Firm* — Irving Keschner

(57) ABSTRACT

A tubular shaped slide having first and second spaced ends for use with a fretted musical instrument, the first end having a diameter greater than the second end. The slide is positioned on the finger of a wearer such that the wearer's fingertip extends beyond the second end of the slide; the second end of the slide being formed at an angle to the vertical. A sizing slot extends along the length of the slide.

5 Claims, 3 Drawing Sheets

FIG. 1
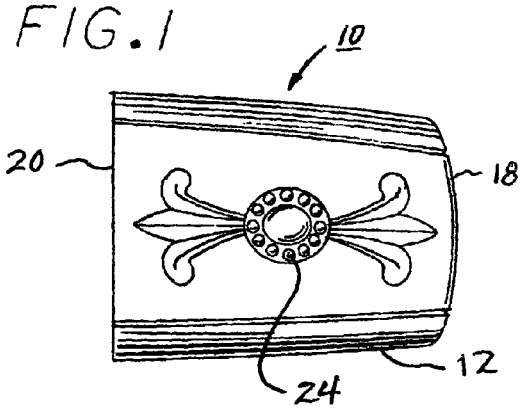
FIG. 2
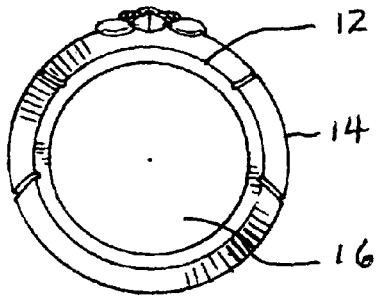
FIG. 3
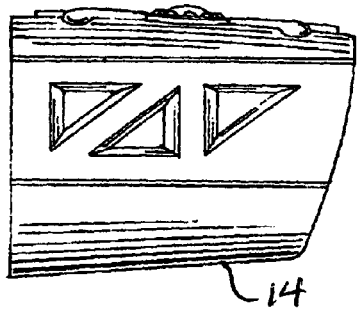
FIG. 4
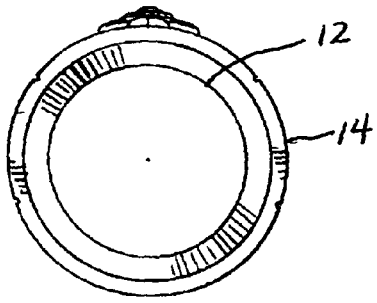
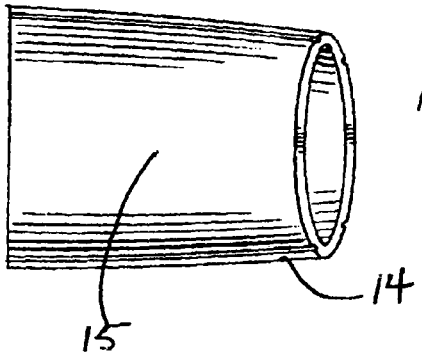
FIG. 5

SLIDE FOR USE WITH FRETTED INSTRUMENTS

RELATED APPLICATIONS

The present application is a continuation-in-part of prior application Ser. No. 12/387,038, filed Apr. 28, 2009 now abandoned.

BACKGROUND OF THE INVENTION

1. Field of the Invention

The present invention provides a new slide for use with fretted instruments, such as guitars.

2. Description of the Prior Art

The use of a slide to provide glissando effects has been known for many years.

The exact origin of the first slide device used on fretted instruments to provide smooth glissando and portamento effects on fretted instruments such as the guitar is not known but the first known recording of this technique dated to 1923 when Sylvester Weaver recorded "Guitar Blues" and "Guitar Rag." Shortly after, many blues guitarists adopted the technique and popularized it. To achieve the slide effect, many guitarists used a small bottle or a cut bottleneck. As time went by, products became available that mimic a small bottle or bottleneck in the form of small cylindrical tubes most often made of glass, brass, or stainless steel. These traditional slides are most often about 2½ inches in length, ⅞ inches in diameter (these measurements vary), and are designed to slip over a finger past the second (middle) knuckle—which means the finger can no longer bend. Additionally, traditional slides are designed to cover many strings of a guitar at once; typically six.

In the modern era of rock and pop music, guitar players have attempted to incorporate slide guitar playing into music as a featured effect for one or perhaps a few songs out of a performing artist's repertoire. Most modern guitar players in rock and pop only need to use the slide on one or two strings at a time. The problem is that the traditional slide is worn over an entire finger which immobilizes that finger and prevents the guitar player from using it for the normal playing of their instrument which requires pressing the strings down to the fretboard with their fingertips—sounding the strings against the frets of the instrument. Guitar players attempting to use these traditional slides must: attempt to play normally with the slide on which is usually extremely difficult; pause their performance briefly to slip the slide on when needed and off again when finished; or abandon using the slide for live performances all together.

Additionally, instrumentalists like guitar players spend countless hours becoming accurate and articulate on their instruments. The mind to hand coordination and awareness it takes to achieve this is focused on the fingertips. Therefore, for an accurate and articulate performance while using a slide device, it is desirable that the slide device be focused on the fingertips as well.

The problem then is that modern rock and pop guitar players need a slide device that achieves the following three objectives: (1) simultaneously be worn and allow the wearer to play normally on their instrument; (2) allow the wearer to use the device to provide smooth glissando effects over the strings; (3) while in use the slide device should still allow the wearer's concentration to be focused on the fingertip to help ensure accuracy and articulation.

The key to solving this problem is that while worn, the slide device must allow the articulation of all the finger's joints, and allow the fingertip to be used in the normal playing of their instrument. While in use as a slide, to allow the wearer to continue a high degree of accuracy and articulation, the slide device should be fitted to the distal phalanx area of the finger.

Examples of prior slide devices are as follows:

(1) The Traditional Slide—This device is designed to slip over the entire finger including the fingertip thereby rendering it unusable for normal playing of the instrument.

(2) The Knuckle Slide—This is a shorter version of the slide noted in paragraph 1 hereinabove. This slide is designed to slip over the finger but stop at the second joint (knuckle joint). In most cases, the slide still covers the fingertip thereby rendering it unusable for normal playing of the instrument. In cases where it does not cover the fingertip, the slide still covers the first joint of the finger thereby rendering it clumsy to use at best. Additionally, this slide does not fit snug or firmly on the finger so if an exposed fingertip is used it merely slips off the finger and onto the fretboard.

(3) The Rock Slide—This device (see U.S. Pat. No. 6,160,212) is similar to a knuckle device but has a tapered interior which provides for a snug and firm fit on the finger helping with accuracy and has an angled cut at the bottom of it where it touches the joint. This allows a person to bend their finger with more comfort. However, it still immobilizes the top joint on the finger and does not allow the fingertip to be used in the normal playing of an instrument.

(4) Jet Slide—This device (see U.S. Pat. No. 6,242,676) is a simple bar across the guitar strings and provides similar results as a traditional slide. While in use as a slide, the performance surface is located on the side of the finger causing the focus of accuracy to be on the side of the finger, not the preferred fingertip. While not in use, the device is resting up and away from the hand—which is bulky. To bring it into use, the user must pull the bar down with the little finger causing it to be unusable at that moment.

(5) The Shubb Axys Reversible Guitar Slide is worn like a traditional ring with the band going around the proximal phalanx of a finger (the bottom portion next to the palm). The playing surface of the slide appears like a traditional slide that has been cut in half along its length. When not in use, the playing surface is rotated up onto the top of the finger. When in use, the thumb of the hand, the device is on pulls on the ring causing it to rotate the playing surface down and into position on the underside of the finger. At this point, the wearer is ready to use it as a slide. When done, the surface can be rotated back on top of the finger. The biggest disadvantage is that the user must stop playing the instrument in order to use his/her thumb to pull the device into playing position.

(6) The Hoolahan Slide is a departure from the tube design of the traditional slide. It does allow the wearer to go from normal playing to slide playing and back but the focus of the playing surface is on the side of the finger. The device is designed to be secured to the finger like a ring with the band going around the intermediate phalanx of a finger (the middle area) and the playing surface extending on the side of the finger behind and in front of the band causing the focus of accuracy to be on the side of the finger, not the preferred fingertip.

(7) The Slide Ring allows the wearer to go from normal playing to slide playing and back but the focus of the playing surface is on the underside and side of the intermediate phalanx of the finger (the middle area). The device is designed to be secured to the finger like a ring with the band going around the intermediate phalanx of the finger. The focus of accuracy while in use as a slide is therefore in the mid-section of the finger, not the preferred fingertip.

(8) The Shy Slide (see U.S. Pat. No. 4,817,488) is similar to a knuckle slide that has been cut in half length-wise. In this case, it's one half of a tube, 1-inch long. It allows the wearer to go form normal playing to slide playing and back but the focus of the 1-inch playing surface is on the underside of the intermediate phalanx of the finger (the middle area). The device is designed to be secured to the finger by using strips of Velcro going around the intermediate phalanx of a finger (the middle area). The focus of accuracy for this device is on the underside of the intermediate phalanx of the finger (the middle area), not the preferred fingertip.

Although the prior art devices noted hereinabove provide certain advantages, no existing slide device has succeeded in solving the need of guitar players to have a slide device that achieves all three of the objectives listed hereinabove.

SUMMARY OF THE INVENTION

The slide of the present invention is designed to be a device for people playing fretted instruments. It is worn on the distal phalanx area of the finger, i.e. the fingertip. In order for it to grip the fingertip it is tapered across its length, being smaller on one end than the other and providing a snug and firm fit. The device is small enough overall so that it doesn't interfere with any of the joints of the finger and the smaller of the two openings allows enough of the fingertip to protrude through so that the wearer can still play their instrument normally while wearing the device. At any moment, the wearer can use the device as a slide to provide smooth glissando and portamento effects over the strings and return to normal playing without a pause or removing the device. While in use as a slide, the playing area is located on the underside of the distal phalanx area of the finger; this allows the wearer's concentration to be focused on the fingertip to help ensure accuracy and articulation.

The slide of the present invention can be created using various materials and/or combinations of materials as long as the playing surface is polished smooth. The materials of choice are polished steel, stainless steel, chrome, porcelain, brass, ceramic, glass, or pyrex glass.

The present invention thus provides a simple and cost effective slide that meets all the needs of a user of a fretted instrument. In addition, the present invention includes a slot that extends along the length of the slide and enables the slide to accommodate various sizes of a user's finger.

DESCRIPTION OF THE DRAWINGS

For a better understanding of the present invention as well as other objects and further features thereof, reference is made to the following description which is to be read in conjunction with the accompanying drawing therein:

FIG. 1 is a top view of the slide of the present invention;

FIG. 2 is a front view of the slide of the present invention;

FIG. 3 is a right side view of the slide of the present invention (left side view is a mirror image);

FIG. 4 is a rear view of the slide;

FIG. 5 is a bottom view of the slide;

DESCRIPTION OF THE INVENTION

Referring now to FIGS. 1-5, various views of the slide 10 of one embodiment of the present invention is illustrated.

Slide 10 has tubular shaped interior and exterior surfaces 12 and 14, respectively, and an opening 16.

Figure 11:
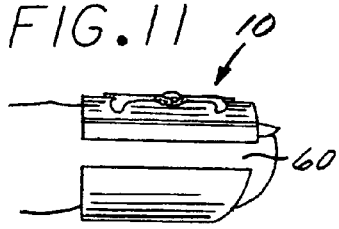
FIG. 11 illustrates the slide of the present invention having a sizing slot extending along the length of the slide.

Slide 10 is worn on the distal phalanx area of the finger, the fingertip. In order for the slide to grip the fingertip it is tapered across its length, the diameter at end 18 being less than the diameter at end 20 thus providing a snug and firm fit. As discussed hereinbelow, FIG. 11 illustrates a second embodiment of the invention wherein a sizing slot enables slide 10 to expand to accommodate different finger sizes. Slide 10 is small enough overall so that it doesn't interfere with any of the joints of the wearer's finger and opening 18 allows enough of the fingertip to protrude through so that the wearer can still play his/her instrument normally while wearing the device. Thus, the wearer can use the device as a slide to provide smooth glissando and portamento effects over the strings and return to normal playing without a pause or removing the device. While used as a slide, the playing area 15 is located on the underside of the distal phalanx area of the finger, allowing the concentration of the wearer to be focused on the fingertip to help ensure accuracy and articulation.

Slide 10 can be created using various materials and/or combinations of materials as long as the playing surface is polished smooth. The materials that can be used to fabricate slide 10 include polished steel, stainless steel, chrome, porcelain, brass, ceramic, glass, or pyrex glass.

Slide 10, as noted hereinabove, is hollow and worn on a user's fingertip, allowing approximately ¼ of the fingertip to extend beyond opening 18. The thickness of the slide is approximately 1/32".

Designs, other than the Fleur de Lis design 24 illustrated, can be formed on the exterior surface of slide 10.

Typical dimensions of the slide 10 (shown in the horizontal position) are as follows:

Height: ⅞"

Top Width (diameter): 9/16"

Bottom Width (diameter): 11/16"

The above dimensions provide a taper of 2⅛" from top to bottom.

Figure 6:
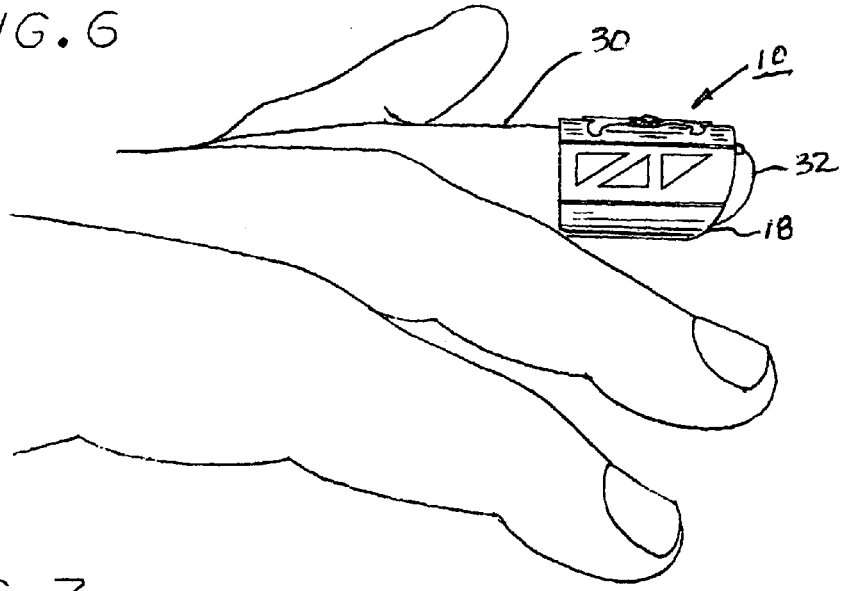
FIG. 6 illustrates the slide placed on a finger of a user.

FIG. 6 illustrates the slide 10 positioned on the finger 30 of a wearer with the fingertip 32 extending beyond end 18.

Figure 7:
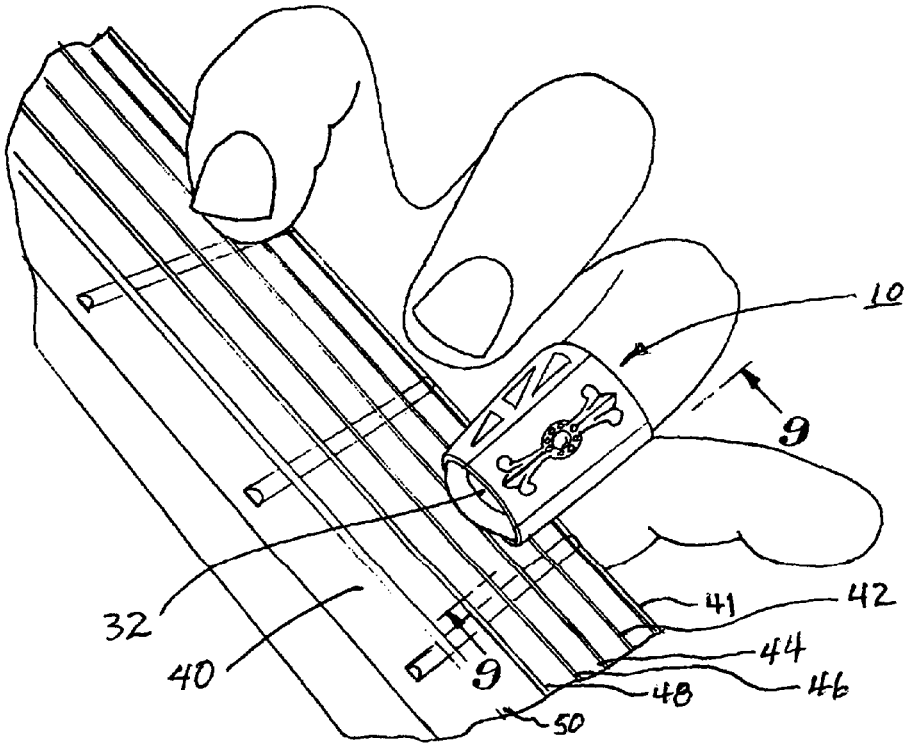
FIG. 7 illustrates a string being held down on a fret with a fingertip while the slide is being worn on that finger.

FIG. 7 illustrates a fretboard 40, such as one used with a guitar, having strings 41, 42, 44, 46, 48 and 50 thereon, string 44 being held down on fretboard 40 by extended fingertip 32 of a wearer.

Figure 8:
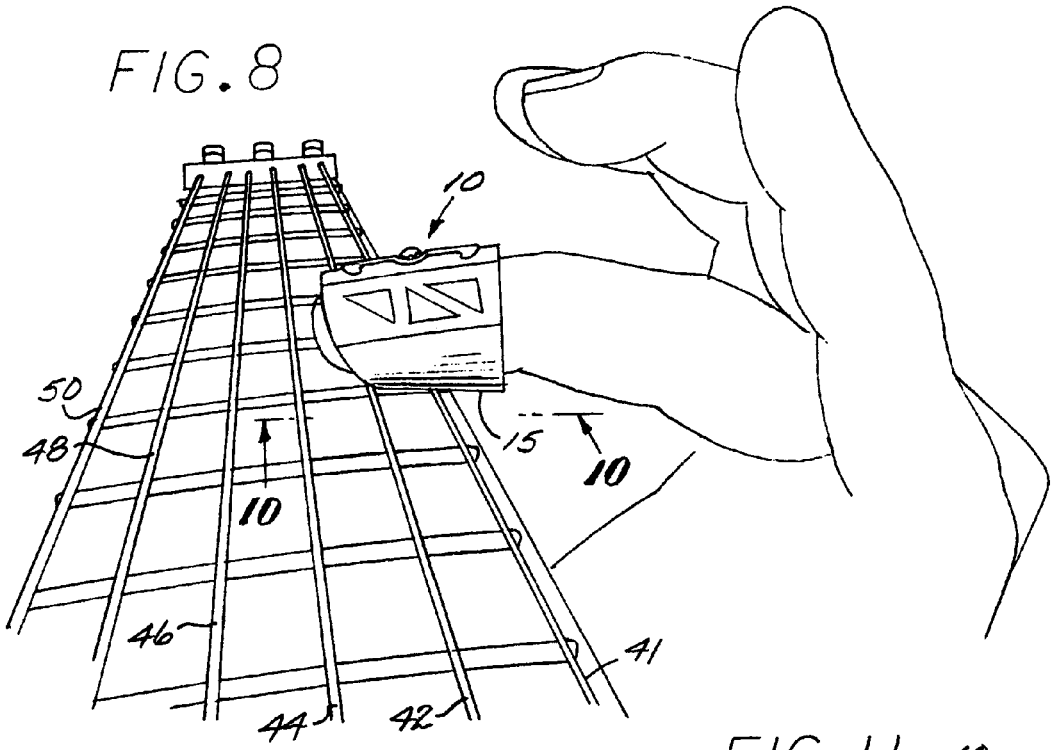
FIG. 8 illustrates the device being used as a slide.

FIG. 8 shows slide 10 in use positioned in a manner whereby the bottom surface 15 thereof is contacting string 41, fingertip 32 not contacting any of the other strings directly.

Figure 9:
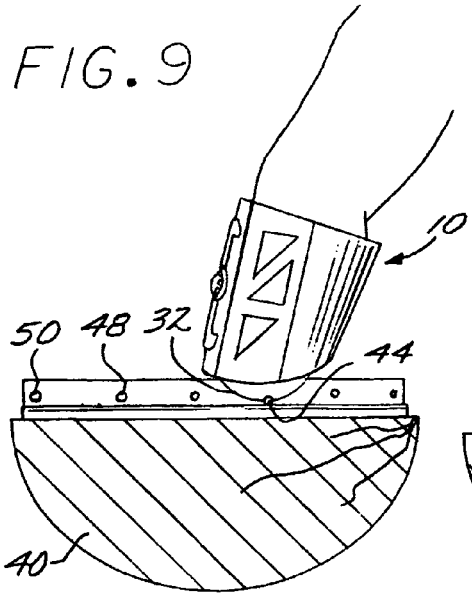
FIG. 9 is a cross section taken on line 9-9 of FIG. 7 showing the slide not interfering while a user holds down a string on a fret.

FIG. 9 is a cross-section along line 9-9 of FIG. 7 and shows how fingertip 32 only contacts string 44 with no interference from slide 10.

Figure 10:
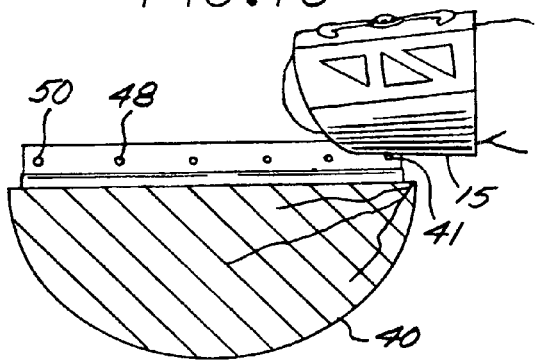
FIG. 10 is a cross section taken on line 10-10 of FIG. 8 showing the slide contacting a string.

FIG. 10 is a cross-sectional view along line 10-10 of FIG. 8 and shows the bottom surface 15 of slide 10 contacting only string 41.

FIG. 11 shows slide 10 modified to incorporate a sizing slot 60 that extends along the length of the slide; the slot 60 allowing slide 10 to accommodate various finger sizes of a user.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A slide for use with a fretted music instrument having a plurality of strings comprising a hollow-shaped elongated member extending along a longitudinal axis having first and second end portions and a bottom portion, said first end portion having a diameter greater than the diameter of said second end forming a taper, said slide being shaped such that when it is placed on a finger of a user, the user's fingertip extending beyond said second end of said slide, said second end of slide being formed at an angle to said longitudinal axis, a slot extending along the length of said longitudinal axis.

2. The slide of claim 1 wherein said slide is fabricated from plastic.

3. The slide of claim 1 wherein in a first playing mode only said extended fingertip contacts at least one of said strings.

4. The slide of claim 1 wherein in a second playing mode only said bottom portion contacts at least one of said strings.

5. The slide of claim 1 said slide angle enables the fingertip to extend beyond the second end of said slide.

* * * * *